United States Patent [19]

Travaglio

[11] 4,013,222

[45] Mar. 22, 1977

[54] ROTATING WASHER ASSEMBLY

[75] Inventor: Dalny Travaglio, Kensington, Calif.

[73] Assignee: Jack Rogers, Concord, Calif.

[22] Filed: Sept. 22, 1975

[21] Appl. No.: 615,515

[52] U.S. Cl. ..... 239/98; 239/227; 239/248; 239/255

[51] Int. Cl.[2] ..... B05B 3/06; B05B 3/16

[58] Field of Search ..... 239/97, 98, 227, 244, 239/246, 248, 249, 255, 256, 262

[56] References Cited

UNITED STATES PATENTS

| | | | |
|---|---|---|---|
| 1,155,115 | 9/1915 | Watson | 239/98 |
| 2,074,052 | 3/1937 | George | 239/227 |
| 3,625,425 | 12/1971 | Robinson | 239/227 |

*Primary Examiner*—Evon C. Blunk
*Assistant Examiner*—Andres Kashnikow
*Attorney, Agent, or Firm*—Harris Zimmerman

[57] ABSTRACT

An apparatus for spray washing the interior of vessels includes a body member secured to a fluid supply line, and a housing rotatably secured to the body and in flow communication therewith. A hub is rotatably secured to the housing on an axis transverse to the body-housing axis, and a plurality of nozzles extend radially from the hub perpendicular to the hub axis. A pair of reaction jets also extend radially from the hub to drive the hub in an oscillating motion. The hub is secured to a spindle which is joined to a lever which operates an over center toggle. The toggle operates a valve which alternates the fluid flow to the reaction jets to produce the oscillating hub motion. The lever also drives a ratchet mechanism which incrementally rotates the housing about the body member.

14 Claims, 9 Drawing Figures

ROTATING WASHER ASSEMBLY

BACKGROUND OF THE INVENTION

There are many devices available in the prior art for cleansing the interior of a tank or vat prior to refilling the vessel. As carrying vessels such as tank trailers and seagoing tankers have become larger, and labor costs has escalated, the desirability of automatic washing systems has increased. Such systems must scan all of the interior vessel surface with a high pressure cleansing solution which may be hot and/or corrosive. Furthermore, since the cleansing liquid is often recirculated with little or no filtration, the systems must be able to tolerate suspended particulate matter with clogging or breakdown.

Of the prior art devices, some include a plurality of nozzles which are rotated by a reciprocating piston arrangement driven by the pressure of the cleansing solution.

These piston operated devices may require complicated valving which can be clogged by suspended debris. Furthermore, the reciprocating piston requires too much energy, and may result in a significant pressure drop at the nozzles. Such pressure loss causes a marked decrease in the cleansing effectiveness of the devices.

Other prior art devices include a plurality of nozzles rotated by a turbine motor which is driven by the cleansing fluid. The turbine requires rather delicate needle or roller bearing mounting, and the bearings generally must be sealed to prevent exposure to the corrosing cleansing solution. Once the seals break down, a likely eventuality, the bearings cannot withstand the corrosion and the suspended particulate matter from the fluid, and soon fail.

SUMMARY OF THE INVENTION

The present invention generally comprises a device adapted for cleansing the interior of a vessel with jets of high pressure liquid. The device includes a plurality of nozzles extending from a hub, and a pair of opposed reaction jets extending from the hub which are actuated alternately by a valve to drive the hub in oscillating rotational motion. The hub is secured to a spindle which is rotatably mounted in a housing.

The valve is secured to one end of a shaft which extends axially through the spindle. An over center toggle arm is secured to the other end of the valve shaft, and is driven reciprocally past center by an arm extending from the end of the spindle. Thus rotation of the hub by one jet in one direction causes the toggle arm to snap back through center, resulting in the valve redirecting the flow to the other jet which drives the hub in the opposite direction.

The housing is rotatably secured to a body member pawl and ratchet assembly is secured to the end of the body member which extends through the housing, the pawl being secured on a pawl plate which rotates about a fixed ratchet wheel. The pawl plate is joined to the spindle arm by a rigid linking member so that the pawl plate is also driven reciprocally to drive the pawl into engagement with the ratchet wheel and rotate the housing about the body member.

As the hub oscillates and the housing rotates, the nozzles will spray every point on a sphere. It should be noted that the present invention requires no reciprocating pistons or delicate turbines, and indeed operates with only one internal moving part. Thus the present invention is designed to be long-lived and rugged, requiring a minimum of maintenance.

THE DRAWING

DESCRIPTION OF THE PREFERRED EMBODIMENT

The present invention generally comprises a washer which is adapted to direct a plurality of high pressure liquid streams at the interior of a vessel, and which sweeps the streams through a plane as the device rotates about an axis parallel to the plane. The washer thus covers the entire interior surface of the vessel with cleansing liquid to effect complete washing of the vessel.

Figure 1:
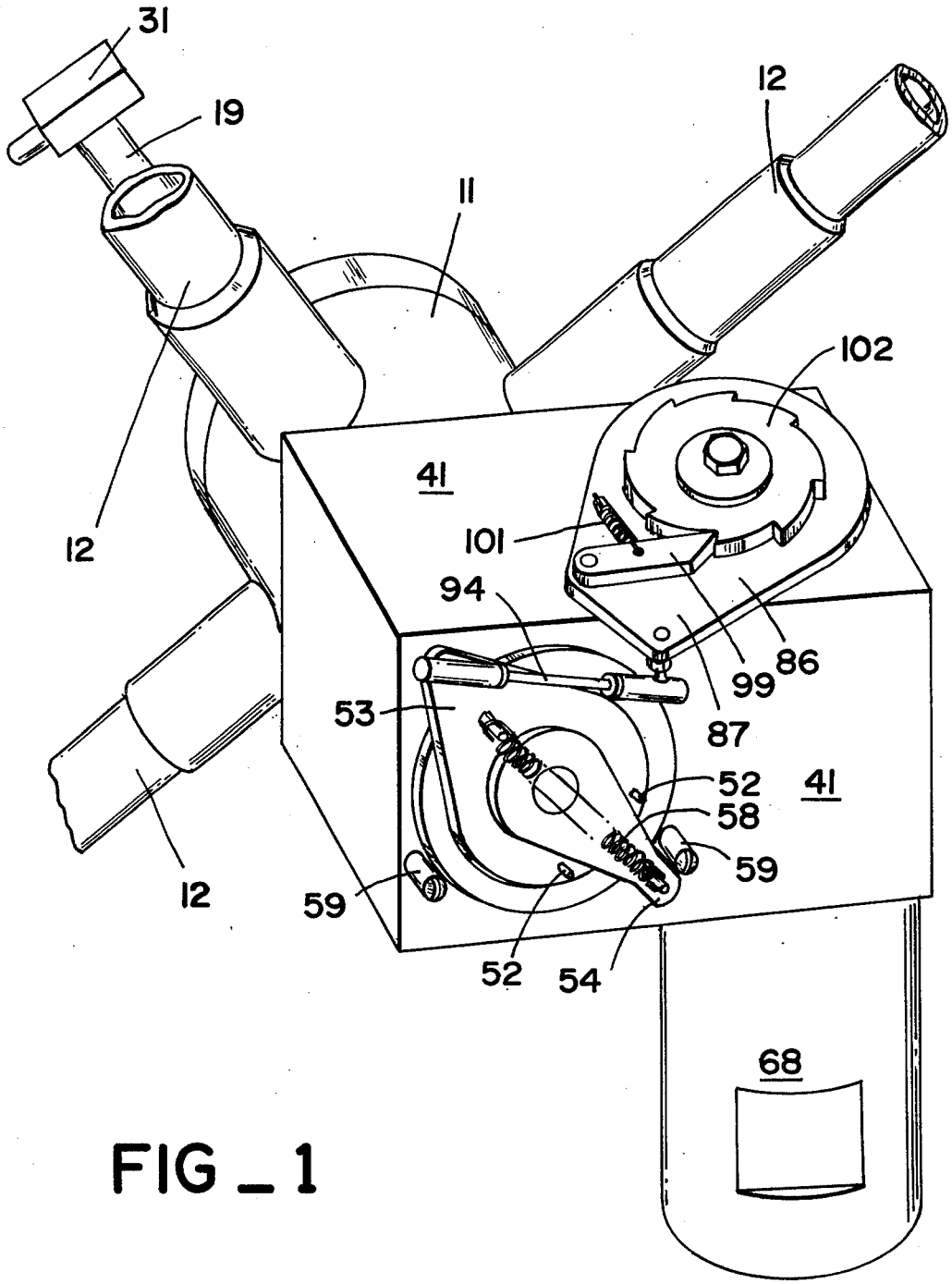
FIG. 1 is a perspective view of the washer device of the present invention.
Figure 3:
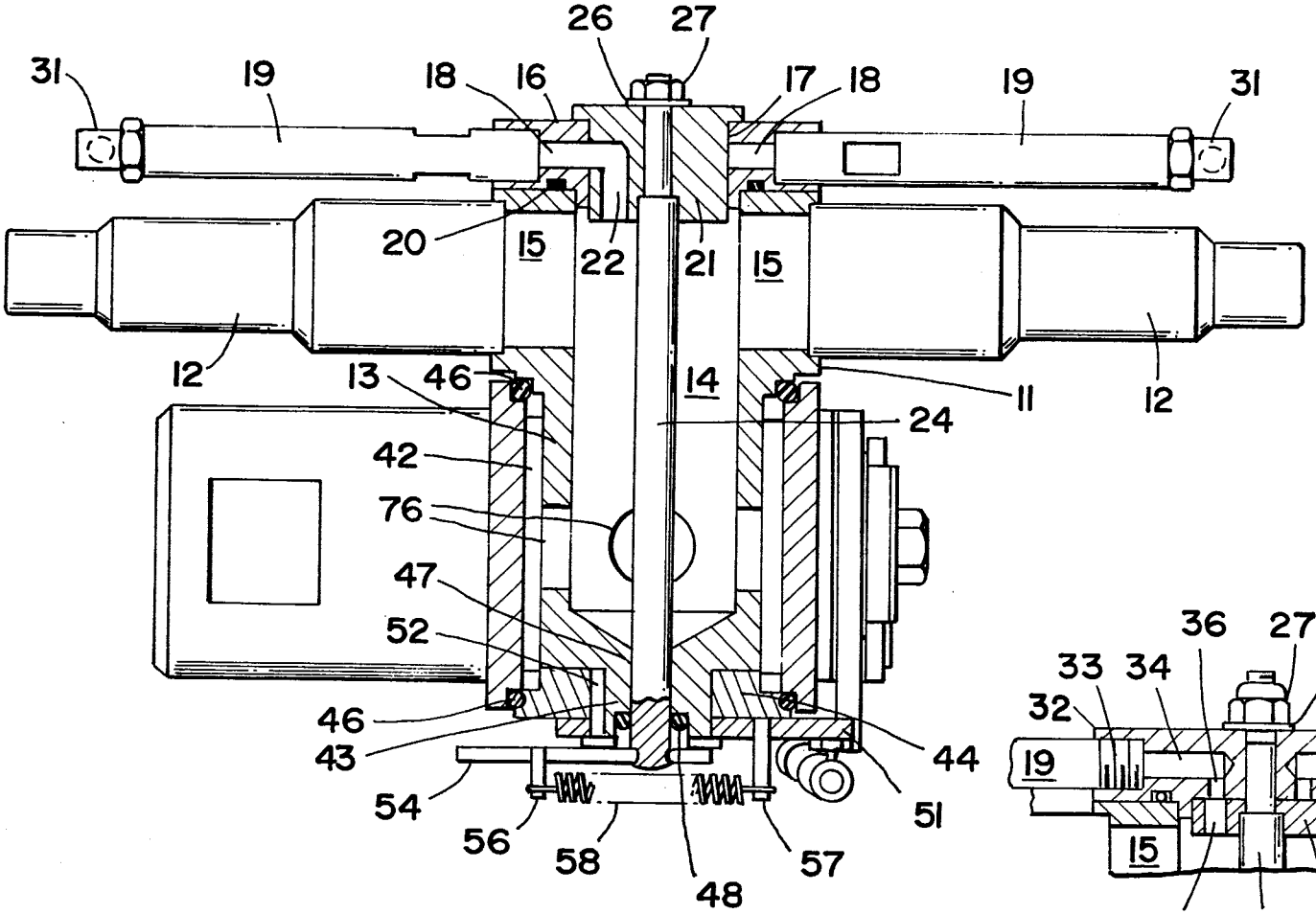
FIG. 3 is a cross-sectional elevation of the washer of the present invention, taken along line 3—3 of FIG. 2.

With reference to FIGS. 1 and 3, the washer includes a rotatable hub 11, from which extend a plurality of nozzles 12. In the preferred embodiment, four nozzles are spaced orthogonally about the hub 11, extending radially therefrom. The hub extends integrally from a spindle 13 which includes an axially disposed cavity 14 therein with ports 15 in flow communication with the nozzles. Secured to the exterior end of the hub is a circular plate 16, which is provided with an axially disposed hole 17 and an O-ring seal 20 with the hub. A pair of opposed holes 18 extend diametrically from the hole 17, and each receive therein a hollow tubular jet arm 19.

Figure 7:
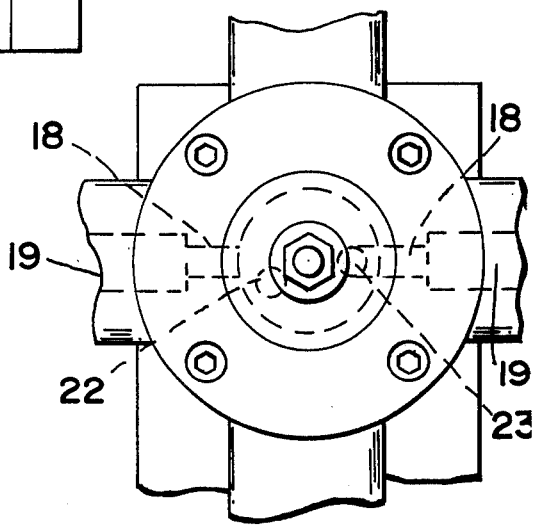
FIG. 7 is a detailed top view of the hub of the present invention.
Figure 6:
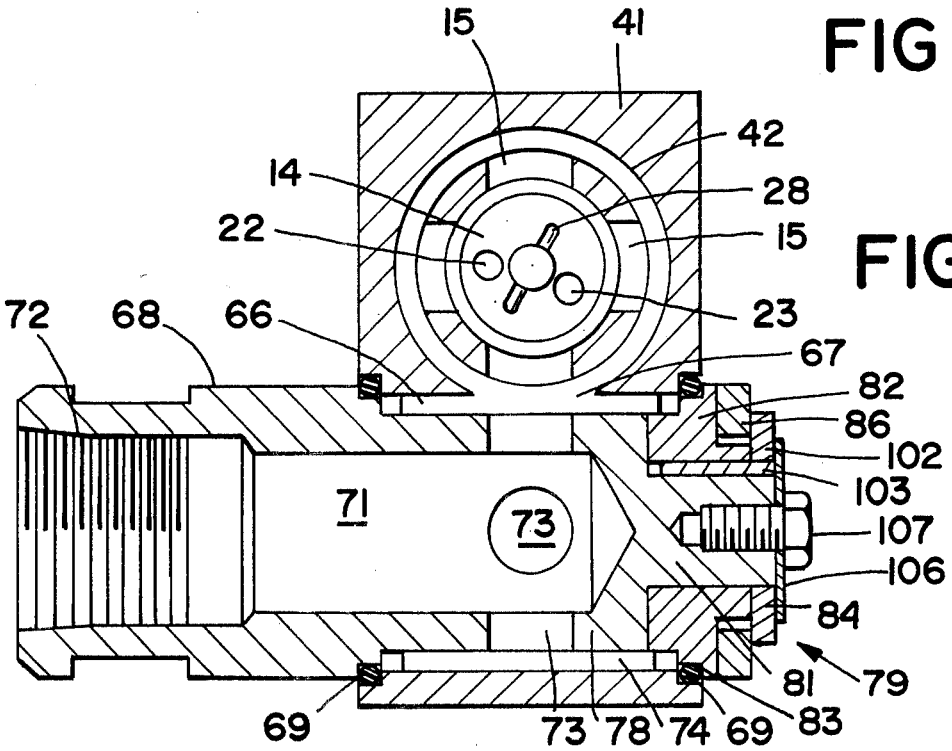
FIG. 6 is a cross-sectional elevation of the washer, taken along line 6—6 of FIG. 5.

Received within the hole 17 is a cylindrical valve 21, which is also seen in FIGS. 6 and 7. The valve includes a pair of fluid flow passages 22 and 23 therethrough, extending from the cavity 14 to the holes 18. It should be noted that although the holes 18 are diametrically opposed, the passages 22 and 23 subtend an angle less than 180°, so that only one jet arm 19 may be in flow communication with the cavity 14 at any instant, according to the rotational orientation of the valve 21. The valve is secured to a valve shaft 24, which extends coaxially through the cavity 14 and through the valve itself. A washer 26 and nut 27 secure the shaft, and thus the valve-end plate assembly to the hub. A pin extending through the valve shaft is received in slot 28 in the valve. It may be noted that the valve freely rotates in the hole 17, and that such rotation is determined by the valve shaft.

The distal ends of the jet arms 19 are each provided with a reaction jet 31. Both jets 31 are directed in the same direction, perpendicular to the arms 19 and to the axis of the spindle 13. High pressure liquid provided through the valve 21 to the jets drives the hub and spindle in rotational motion, each jet counteracting the other and supplied alternately by the valve to drive the hub and spindle in an oscillatory rotational mode. Due to the fact that the jets are supplied in parallel flow with the nozzles 15, the jets do not significantly reduce the pressure available to the nozzles. The jets require approximately 5 percent of the total nozzle flow, and even this small amount of liquid is not wasted, as it too is sprayed at the walls of the vessel being cleaned.

Figure 4:
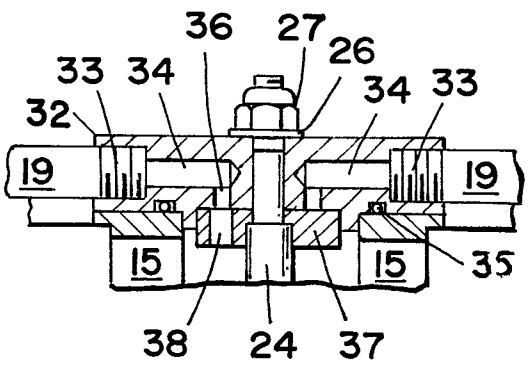
FIG. 4 is a detailed cross-sectional view of an alternative valve embodiment of the washer of the present invention.

An alternative embodiment of the valve assembly, shown in FIG. 4, includes a circular end plate 32 secured to the exterior end of the hub, and provided with an O-ring seal 35 therebetween. The plate 32 includes a pair of diametrically extending threaded holes 33, from which extend fluid passages 34 inwardly. These passages 34 each connect to a hole 36 aligned parallel with the axis of the plate 32. The valve shaft 24 extends freely through an axial hole in the plate, and a washer 26 and nut 27 secure the assembly together.

The plate is provided with an annular recess in the interior surface thereof, in which is disposed a valve disc 37. The valve disc is secured to the valve shaft which passes therethrough, and the disc is provided with a pair of holes 38 extending therethrough parallel to the axis thereof. The holes 38 are opposed non-diametrically in the valve disc, so that only one hole 38 may be aligned with one hole 36 at any instant as the disc oscillates in concert with the valve shaft. Thus the jets 31 are supplied alternately with high pressure liquid to drive the hub in oscillating rotational motion.

Figure 2:
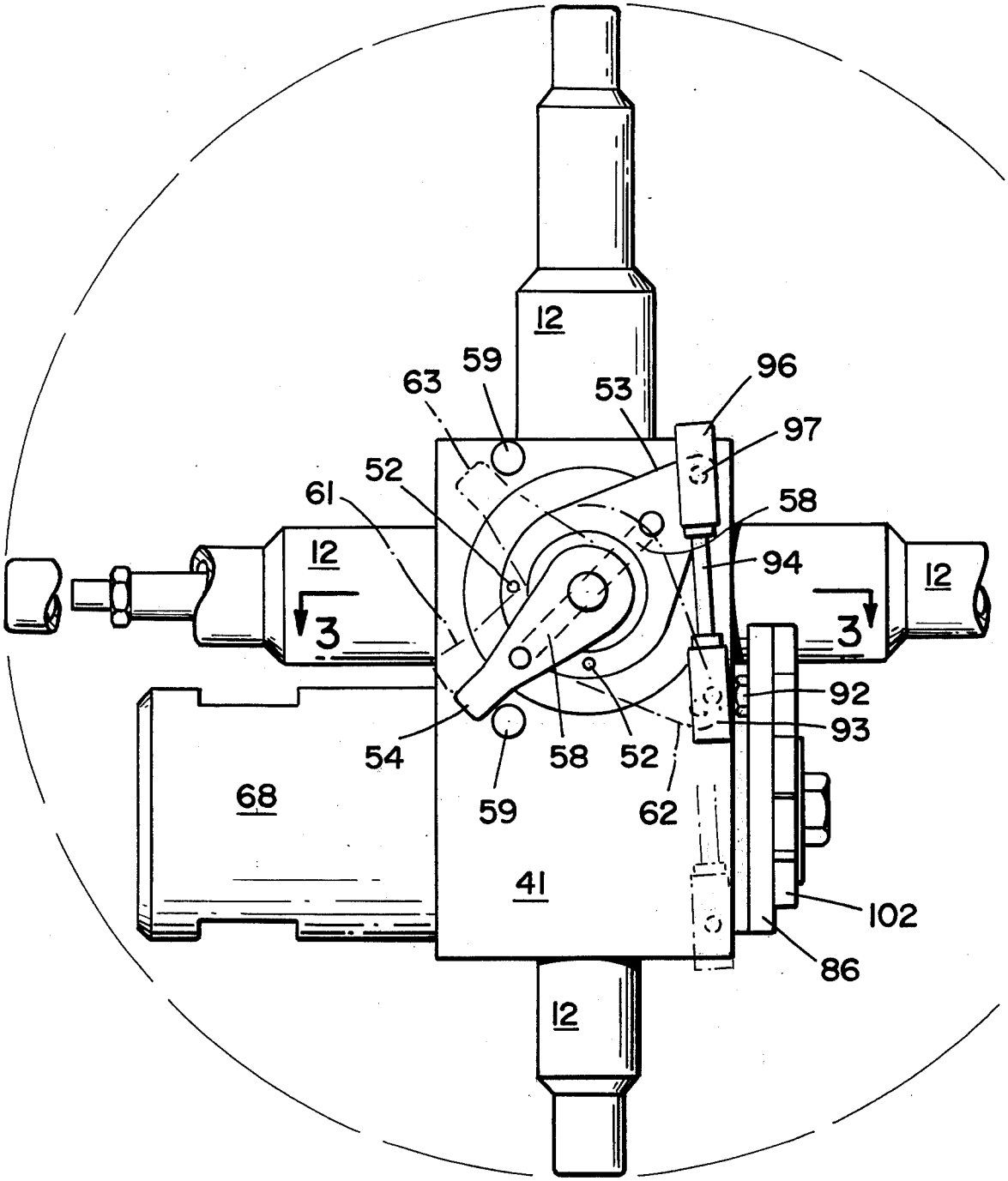
FIG. 2 is a bottom view of the washer of the present invention.
Figure 5:
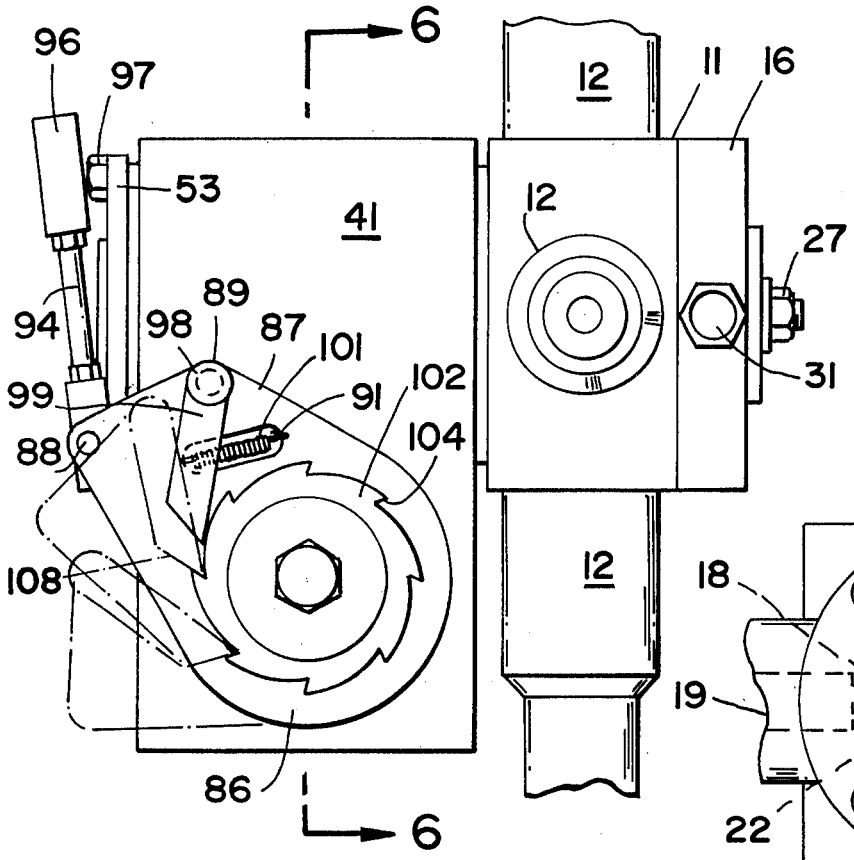
FIG. 5 is a side view of the washer of the present invention.

The present invention includes a rectangular housing 41, as shown in FIGS. 2, 5, and 6. The housing includes a cylindrical passage 42 therethrough, in which is received a portion of the spindle 13. The spindle includes a neck 43 which extends through an end cap 44 secured thereto and received in the end of the passage 42. A pair of cageless ball bearings 46 secure the spindle and end cap assembly in freely rotating fashion in the passage 42. The neck of the spindle includes an axially disposed hole 47 therethrough through which the valve shaft freely extends. A ball bearing 48 secured in an annular recess in the end of the spindle supports the valve shaft so that it rotates independently of the spindle.

With reference to FIGS. 1, 2, and 3, the invention includes a spindle arm 51 disposed fixedly about the neck 43 of the spindle and including a pair of pins 52 extending outwardly therefrom. The spindle arm generally comprises a plate disposed normally to the spindle and having a protrusion 53 extending therefrom in the plane of the plate, with a centrally disposed hole for receiving the spindle neck. Joined to the end of the valve shaft extending from the spindle neck is a toggle arm 54 which is parallel to the spindle arm and spaced therefrom by a washer. The distal portion of the toggle arm 54 is generally diametrically opposed to the protrusion 53 of the spindle arm.

Extending from the respective distal portions of the toggle arm and spindle arm are posts 56 and 57. A helical extension spring 58 is joined between these posts to create an over-center toggle assembly in which the spring acts to snap the toggle arm through the unstable center position. The toggel arm travel is limited in this motion by the pins 52 and also by a pair of spaced stops 59 extending from the housing 41 adjacent to the toggle mechanism.

With reference to FIG. 2, when the spindle arm is in the fully counterclockwise position as shown, the toggle arm is biased by the spring 58 to impinge on a pin 52, as shown in phantom at 61. The spindle and arm are urged in the clockwise direction by the appropriate reaction jet 31. As the spindle arm rotates, the toggle arm rotates in the same direction, due to the action of the spring. As the spindle arm approaches a 90° angular excursion, shown in phantom line at 62, the toggle arm strikes the stop 59, as shown in phantom line at 63, and ceases movement. As the spindle arm continues to rotate and reaches the 90° excursion the spring passes through the center (diametrical) position and snaps the toggle arm counterclockwise. This action causes the valve to direct liquid flow to the other reaction jet, urging the spindle and hub in the opposite, counterclockwise direction. The sequence is then reiterated, so that the hub and spindle are driven continuously in oscillating rotational motion.

The housing 41 is provided with a second cylindrical hole 66 therethrough, disposed in the other end of the housing and perpendicular to the hole 42. The two holes are connected in open flow communication by a channel 67. Received in the hold 66 is a generally cylindrical arbor 68, secured therein in freely rotating fashion by a pair of cageless ball bearings 69. The arbor includes an axial bore 71 which is provided with tapering pipe threads 72 at one end. A pair of diametrical holes 73 extend through the arbor and the interior end of the bore to an annular cavity 74 extending between the hole 66 and the periphery of the arbor. Thus there is unrestricted flow communication from a supply pipe secured to threads 72 through the bore, the holes 73, the cavity 74, and the channel 67 to the spindle hole 14. It should be noted that the spindle is provided with a pair of diametrical holes 76 communicating with the channel 67, so that liquid may flow through to the valve 21 with the spindle and arbor in any angular disposition.

Joined to the end 78 of the arbor is a ratchet and pawl assembly 79 which is adapted to rotate the housing 41 about the arbor. The end 78 of the arbor includes a neck 81 which receives a collar 82 thereabout. The exterior of the collar 82 is provided with adjoining annular surfaces 83 and 84, of stepped, reduced diameters. The surface 83 includes an annular groove which receives the bearing balls 69.

Secured in rotating fashion about the annular surface 84 is a pawl arm 86, which comprises a plate member having an eccentric portion 87 extending therefrom in a planar fashion. A pair of spaced holes 88 and 89 are disposed in the portion 87, as is a slot 91 extending through the pawl arm. Secured in the hole 88 ia a pivot pin 92, which is rotatably joined to one end 93 of a linking member 94. The other end 96 of the linking member is rotatably joined to a pivot pin 97 extending from the protrusion 53 of the spindle arm. Thus the pawl arm is driven by the spindle arm in oscillating rotational motion about the arbor, in synchronism with the spindle arm motion.

A pivot pin 98 extends from the hole 89 in the pawl arm, and pivotally secures a pawl 99 to the arm. The pawl includes an obliquely pointed detent at the distal end thereof. A helical extension spring 101 is disposed in the slot 91, secured at either end to the pawl 99 and to the pawl arm to bias the pawl counterclockwise, as viewed in FIG. 5.

Joined to the neck 81 of the arbor is a ratchet wheel 102, which is press fit on the neck and further secured by a key 103, as is known in the art. The ratchet wheel is provided with a plurality of circumferentially spaced, adjacent ratchet teeth 104 which are angularly offset and adapted to be engaged by the detent of the pawl. The pawl and ratchet assembly, including the collar, is retained in place by a washer 106 and bolt 107 received in a threaded hole disposed axially in the neck 81 of the arbor.

It may be appreciated that as the spindle arm is driven in a clockwise direction (as viewed in FIG. 2) by one of the reaction jets, the pawl arm is also driven in a clockwise direction (as viewed in FIG. 5) by the linking member. The pawl detent is urged by spring 101 to engage a tooth of the ratchet wheel, as shown in phantom line at 108. As the ratchet wheel is fixed to the arbor, the relative motion of the pawl arm and ratchet wheel is realized by the housing 41 rotating clockwise about the arbor. Thus the periodic oscillating motion of the spindle drives the housing in incremental, unidirectional rotation about the arbor. After the nozzles spray and cover a circular swath, the housing rotates so that the nozzles will cover an adjacent circular swath. Thus all points on the interior of a vessel will be covered by the nozzle spray.

A second pawl may be provided on the pawl arm to enegage the ratchet wheel as the pawl arm returns in a clockwise motion, thus preventing any retrograde rotation of the housing. Alternatively, an escapement mechanism may be employed in place of the pawl and ratchet mechanism to rotate the housing about the arbor.

Figure 8:
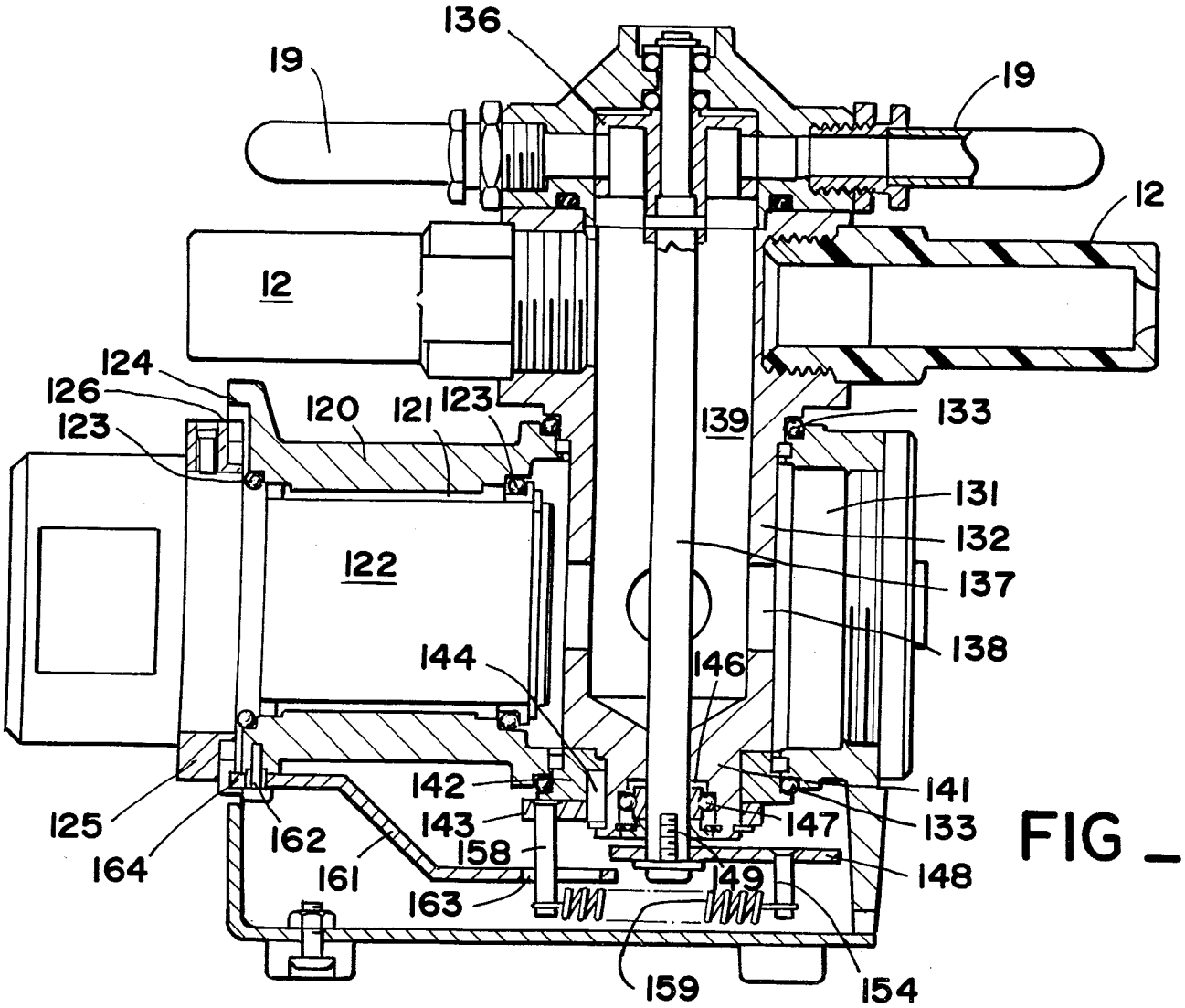
FIG. 8 is a cross-sectional elevation of a further embodiment of the present invention.
Figure 9:
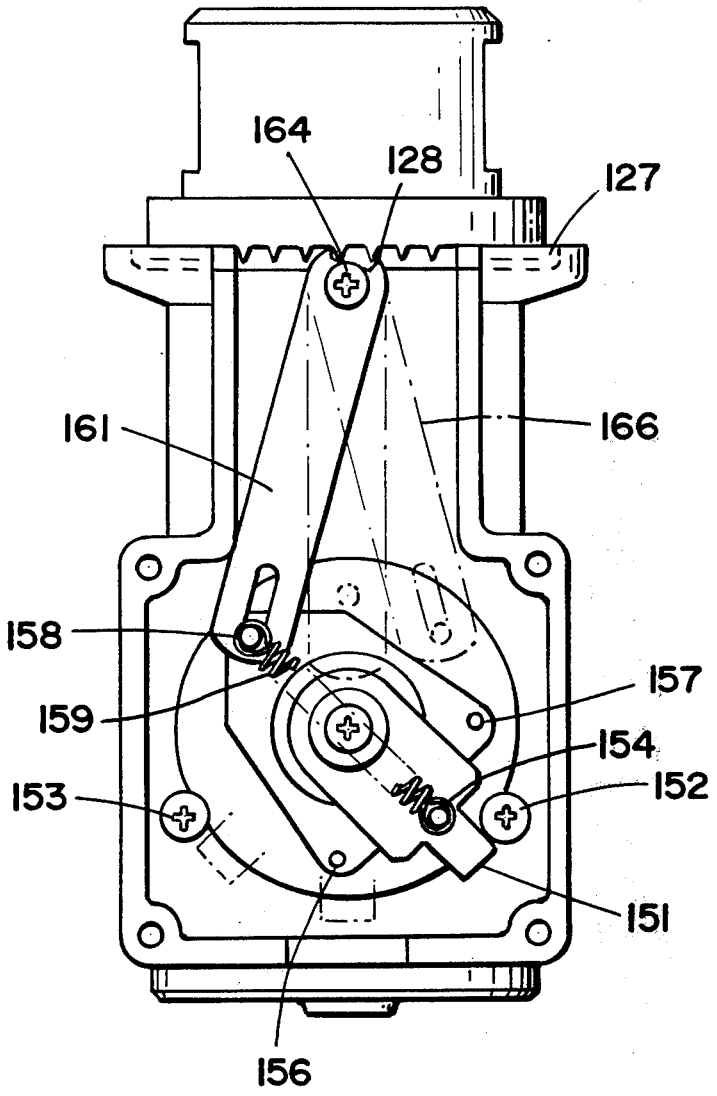
FIG. 9 is a bottom view of the further embodiment depicted in FIG. 8.

Such an escapement mechanism is incorporated in the embodiment shown in FIGS. 8 and 9. With reference to FIG. 8, it includes a housing 120 which is provided with a cylindrical hole 121 therein. Received in the hole 121 is a cylindrical arbor 122 which is rotatably secured therein by a pair of cageless ball bearings 123. The housing is provided with an annular flange 124 disposed about the exterior opening of the hole 121, and an annular recess 127 is disposed in the external face of the flange. The arbor, which is connected to a high pressure fluid source (not shown), includes an annular shoulder 125 extending therefrom and freely received in the annular recess 127. The shoulder is provided with a plurality of circumferentially spaced triangular teeth 128, as shown in FIG. 9.

The housing also includes a centrally disposed internal cavity 131 through which a spindle 132 is received. The spindle is rotatably supported in the housing by a pair of cageless ball bearings 133. The spindle includes a hub integrally formed therewith and extending from one end of the housing. The hub includes a rotating valve 136 disposed therein to control the flow of liquid to a pair of reaction jets 19 extending therefrom, as in the previous embodiment, as well as a valve shaft 137 joined to the valve and extending through the hollow interior of the spindle. A plurality of high pressure nozzles also extend from the hub to direct streams of liquid onto the walls of a vessel to be cleaned.

It may be appreciated that there is open flow communication through the bore of the arbor to the cavity 131. The fluid then flows through the port 138 in the spindle to the hollow bore 139 thereof, and thence to the nozzles and the jets.

The distal end of the spindle is provided with a narrow neck portion 141 which extends from the housing 120. Joined to the neck is an annular end cap 142 which is also rotatably secured in the housing by means of the bearing 133. Secured to the neck adjacent to the end cap is a spindle arm 143. Both the end cap and the spindle arm are rotationally secured to the spindle by a key 144 extending therethrough and secured in the spindle.

The neck 141 of the spindle includes an annular recess 146 in the end thereof, through which the distal end of the valve shaft extends. A ball bearing 147 is secured in the recess 146 to rotatably support the valve shaft. Joined to the end of the valve shaft is a toggle arm 148, which is secured thereto by a screw 149 extending axially into the valve shaft. The toggle arm includes a tail 151 extending therefrom which is adapted to impinge on either of a pair of stops 152 or 153 which extend from the bottom of the housing. The toggle arm is also provided with a pin 154 extending normally therefrom.

The spindle arm is provided with a pair of stop pins 156 and 157 which extend normally therefrom and are disposed to impinge on the toggle arm during the operation of the invention. On the opposite side of the spindle arm there is formed an angular extension of the arm, from which an anchor pin 158 extends normally. Extending between the pins 154 and 158 is a helical extension spring 159 which links the spindle arm and the toggle arm together in an over-center toggle movement.

The present embodiment also includes a lever arm 161 secured to the housing 120 by a pivot pin 162 disposed adjacent to the arbor shoulder 125. One end of the lever arm is provided with a slot 163 through which the anchor pin 158 extends freely. The other end of the lever arm is provided with an arcuate slot 164 which engages the teeth 128 of the arbor in the manner of an escapement mechanism. The slot is sufficiently wide to engage two teeth at a time, and the lever arm is tapered adjacent to the slot so that as the lever arm oscillates pivotally about the pin 162 the teeth are alternately engaged by the slot and then driven by the tapered portion to the left, as viewed in FIG. 9.

In the present embodiment the spindle arm and the toggle arm cooperatively function as in the previous embodiment, the spindle arm oscillating and snapping the toggle arm through the center position, and the toggle arm controlling the valve which directs the liquid flow alternately to the reaction jets. As the spindle arm oscillates the lever is driven to oscillate pivotally about the pin 162, the slot 163 being dimensioned to accommodate the relative translatory motion therebetween. As the lever is rotated from the position shown at 161 in FIG. 9, to the maximum angular displacement shown in phantom at 166, the slot 164 releases one of the teeth 128 and drives the arbor to the left to engage the next tooth.

It may be appreciated that as the arbor is fixed to the liquid supply, the housing is driven to the right by the escapement engagement of the lever and the arbor teeth. Such an escapement drive is generally much slower than the ratchet drive of the previous embodiment, since the arbor is provided with far more teeth than the ratchet wheel. Thus the housing will rotate more slowly about the arbor, and the swaths described in the oscillating nozzles will be spaced more closely together. The cleansing action of the invention is thus increased without complicating the mechanism or requiring any additional internal moving parts.

It should be noted that the present invention provides a washer in which only a small portion of the available pressurized liquid is required to drive the washer, with the drive being aided by the torque reaction of the jets about the arbor. Furthermore, the washer has only one internal moving part; i.e., the valve on its shaft, and this part does not require critical clearances. Thus the prior art difficulties involving high pressure seals, critical clearances which are clogged by suspended particulate matter, and the like, are completely obviated. Also, the present invention is easily disassembled for cleaning and maintenance.

I claim:

1. A washing device using cleansing liquid under pressure, comprising a spindle means rotatably secured in a housing and having a liquid flow channel therethrough, nozzle means extending from said spindle means for spraying said liquid, reaction jet means, extending from said spindle means, for emitting at least one stream of liquid and driving said spindle means in a rotational motion, valve means for selectively permitting liquid flow to said reaction jet means, said valve means including a valve shaft extending coaxially within said spindle means and freely rotating therein, and a valve member secured on said valve shaft adjacent to said reaction jet means and including flow ports extending therethrough from said liquid flow channel of said spindle means to said reaction jet means, arbor means rotatably secured within said housing and including a liquid flow passage connecting a source of said liquid under pressure to said liquid flow channel, switch means for controlling said valve means, said switch means including a toggle arm extending from said valve shaft, a spindle arm extending from said spindle means adjacent to said toggle arm and rotatable about a common axis, first linking means joining said toggle arm and said spindle arm in an over-center toggle fashion, and second linking means extending between said spindle means and said arbor means for driving said housing in rotational motion about said arbor means.

2. The washing device of claim 1, wherein said nozzle means includes a plurality of nozzles extending outwardly from said spindle means and in flow communication with said liquid flow channel.

3. The washing device of claim 1, wherein said jet means includes a plurality of jets in flow communication with said liquid flow channel.

4. The washing device of claim 3, wherein said jets each include a jet arm extending from said spindle means, and a jet joined to said jet arm and in a line directed not coplanar with the axis of said spindle means.

5. The washing device of claim 3, wherein said jets are directed in the same general direction.

6. The washing device of claim 1, wherein said first linking means comprises an elastic extension member.

7. The washing device of claim 1, wherein said arbor means is disposed perpendicularly to said spindle means.

8. The washing device of claim 1, said second linking means including a ratchet wheel fixedly secured about a portion of said arbor means.

9. The washing device of claim 8, further including a pawl arm rotatably secured about said arbor means and disposed adjacent to said ratchet wheel.

10. The washing device of claim 9, including a pawl pivotally secured to said pawl arm and disposed to engage said ratchet wheel.

11. The washing device of claim 10, wherein said second linking means includes a linking member joined between said spindle arm and said pawl arm.

12. The washing device of claim 1, wherein said arbor means includes a plurality of teeth spaced about the circumference thereof.

13. The washing device of claim 12, further including an escapement lever pivotally secured to said spindle arm.

14. The washing device of claim 13, wherein said escapement lever includes a slot for engaging said teeth spaced about said arbor means.

* * * * *